US009094744B1

(12) United States Patent
Lu et al.

(10) Patent No.: US 9,094,744 B1
(45) Date of Patent: Jul. 28, 2015

(54) CLOSE TALK DETECTOR FOR NOISE CANCELLATION

(71) Applicant: Cirrus Logic, Inc., Austin, TX (US)

(72) Inventors: Yang Lu, Austin, TX (US); Dayong Zhou, Austin, TX (US); Jon D. Hendrix, Wimberley, TX (US); Jeffrey Alderson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 308 days.

(21) Appl. No.: 13/724,656

(22) Filed: Dec. 21, 2012

Related U.S. Application Data

(60) Provisional application No. 61/701,187, filed on Sep. 14, 2012.

(51) Int. Cl.
*H04R 29/00* (2006.01)
*H04R 3/00* (2006.01)

(52) U.S. Cl.
CPC ..... *H04R 3/002* (2013.01)

(58) Field of Classification Search
CPC ..... H03G 3/32; H03G 3/24
USPC ..... 381/57, 58
See application file for complete search history.

(56) References Cited

U.S. PATENT DOCUMENTS 5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,410,605 A 4/1995 Sawada et al.

(Continued)

FOREIGN PATENT DOCUMENTS

DE 102011013343 A1 9/2012
EP 1880699 A2 1/2008

(Continued)

OTHER PUBLICATIONS

Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.

(Continued)

*Primary Examiner* — Simon King
(74) *Attorney, Agent, or Firm* — Robert Platt Bell; Steven Lin

(57) ABSTRACT

A close talk detection method and system is provided for active noise cancellation system on a cellular telephone or the like, based on two properly located microphones. Given the location of the microphones and the way people use the phone, the power ratio (difference) at the two microphones implies the location of the speaker within a given range. The improved close-talk detector is not affected by power levels or SNR of non-close-talk ambient disturbances. Power levels of both a voice and a reference microphone are measured and the ratio r of these power levels is determined. If the ratio r is greater than a predetermined threshold (e.g., 7 dB), then close talk is occurring. If the ratio r is less than the predetermined threshold, then the signal is determined to be loud ambient noise or some other non-close-talking signal and noise cancellation processing is not affected.

15 Claims, 4 Drawing Sheets

(56) References Cited

U.S. PATENT DOCUMENTS 5,425,105 A 6/1995 Lo et al.
5,445,517 A 8/1995 Kondou et al.
5,465,413 A 11/1995 Enge et al.
5,548,681 A 8/1996 Gleaves et al.
5,586,190 A 12/1996 Trantow et al.
5,640,450 A 6/1997 Watanabe
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran
6,768,795 B2 7/2004 Feltstrom et al.
6,850,617 B1 2/2005 Weigand
6,940,982 B1 9/2005 Watkins
7,103,188 B1 9/2006 Jones
7,181,030 B2 2/2007 Rasmussen et al.
7,330,739 B2 2/2008 Somayajula
7,365,669 B1 4/2008 Melanson
7,680,456 B2 3/2010 Muhammad et al.
7,742,790 B2 6/2010 Konchitsky et al.
7,817,808 B2 10/2010 Konchitsky et al.
8,019,050 B2 9/2011 Mactavish et al.
8,249,262 B2 8/2012 Chua et al.
8,290,537 B2 10/2012 Lee et al.
8,325,934 B2 12/2012 Kuo
8,379,884 B2 2/2013 Horibe et al.
8,401,200 B2 3/2013 Tiscareno et al.
8,442,251 B2 5/2013 Jensen et al.
2001/0053228 A1 12/2001 Jones
2002/0003887 A1 1/2002 Zhang et al.
2003/0063759 A1 4/2003 Brennan et al.
2003/0185403 A1 10/2003 Sibbald
2004/0047464 A1 3/2004 Yu et al.
2004/0165736 A1 8/2004 Hetherington et al.
2004/0167777 A1 8/2004 Hetherington et al.
2004/0202333 A1 10/2004 Csermak et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0035593 A1 2/2006 Leeds
2006/0069556 A1 3/2006 Nadjar et al.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0177532 A1 7/2008 Greiss et al.
2008/0181422 A1 7/2008 Christoph
2008/0226098 A1 9/2008 Haulick et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0124336 A1 5/2010 Shridhar et al.
2010/0124337 A1 5/2010 Wertz et al.
2010/0150367 A1 6/2010 Mizuno
2010/0158330 A1 6/2010 Guissin et al.
2010/0166203 A1 7/2010 Peissig et al.
2010/0195838 A1 8/2010 Bright
2010/0195844 A1 8/2010 Christoph et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0274564 A1 10/2010 Bakalos et al.
2010/0284546 A1 11/2010 De Brunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0322430 A1 12/2010 Isberg
2011/0007907 A1 1/2011 Park et al.
2011/0106533 A1 5/2011 Yu
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0158419 A1 6/2011 Theverapperuma et al.
2011/0206214 A1 8/2011 Christoph et al.
2011/0222698 A1 9/2011 Asao et al.
2011/0249826 A1 10/2011 Van Leest
2011/0288860 A1 11/2011 Schevciw et al.
2011/0293103 A1* 12/2011 Park et al. ..... 381/57
2011/0299695 A1 12/2011 Nicholson
2011/0305347 A1 12/2011 Wurm
2011/0317848 A1 12/2011 Ivanov et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0207317 A1 8/2012 Abdollahzadeh Milani
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0300958 A1 11/2012 Klemmensen
2012/0300960 A1 11/2012 Macak et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Kamath et al.
2012/0308027 A1 12/2012 Kwatra
2012/0308028 A1 12/2012 Kwatra et al.
2012/0310640 A1 12/2012 Kwatra et al.

(56) References Cited

U.S. PATENT DOCUMENTS

| | | | |
|---|---|---|---|
| 2013/0010982 | A1 | 1/2013 | Elko et al. |
| 2013/0083939 | A1 | 4/2013 | Fellers et al. |
| 2013/0243198 | A1 | 9/2013 | Van Rumpt |
| 2013/0243225 | A1 | 9/2013 | Yokota |
| 2013/0272539 | A1 | 10/2013 | Kim et al. |
| 2013/0287218 | A1 | 10/2013 | Alderson et al. |
| 2013/0287219 | A1 | 10/2013 | Hendrix et al. |
| 2013/0301842 | A1 | 11/2013 | Hendrix et al. |
| 2013/0301846 | A1 | 11/2013 | Alderson et al. |
| 2013/0301847 | A1 | 11/2013 | Alderson et al. |
| 2013/0301848 | A1 | 11/2013 | Zhou et al. |
| 2013/0301849 | A1 | 11/2013 | Alderson et al. |
| 2013/0343556 | A1 | 12/2013 | Bright |
| 2013/0343571 | A1 | 12/2013 | Rayala et al. |
| 2014/0044275 | A1 | 2/2014 | Goldstein et al. |
| 2014/0050332 | A1 | 2/2014 | Nielsen et al. |
| 2014/0086425 | A1 | 3/2014 | Jensen et al. |
| 2014/0177851 | A1 | 6/2014 | Kitazawa et al. |
| 2015/0010403 | A1 | 1/2015 | Wilson et al. |
| 2015/0092953 | A1 | 4/2015 | Abdollahzadeh Milani et al. |

FOREIGN PATENT DOCUMENTS

| | | | |
|---|---|---|---|
| EP | 1947642 | A1 | 7/2008 |
| EP | 2133866 | A1 | 12/2009 |
| EP | 2216774 | A1 | 8/2011 |
| EP | 2395500 | A1 | 12/2011 |
| EP | 2395501 | A1 | 12/2011 |
| GB | 2401744 | A1 | 11/2004 |
| GB | 2455821 | A1 | 6/2009 |
| GB | 2455824 | A1 | 6/2009 |
| GB | 2455828 | A1 | 6/2009 |
| GB | 2484722 | A | 4/2012 |
| JP | H06-186985 | A1 | 7/1994 |
| WO | 03015074 | A2 | 2/2003 |
| WO | WO03015275 | A1 | 2/2003 |
| WO | WO2004009007 | A1 | 1/2004 |
| WO | WO2004017303 | A1 | 2/2004 |
| WO | 2007007916 | A1 | 1/2007 |
| WO | 2007113487 | A1 | 11/2007 |
| WO | 2010117714 | A1 | 10/2010 |
| WO | 2012134874 | A1 | 10/2012 |

OTHER PUBLICATIONS

Erkelens et al., "Tracking of Nonstationary Noise Based on Data-Driven Recursive Noise Power Estimation", IEEE Transactions on Audio Speech, and Language Processing, vol. 16, No. 6, Aug. 2008.

Rao et al., "A Novel Two Stage Single Channle Speech Enhancement Technique", India Conference (INDICON) 2011 Annual IEEE, IEEE, Dec. 15, 2011.

Rangachari et al., "A noise-estimation algorithm for highly non-stationary environments" Speech Communication, Elsevier Science Publishers, vol. 48, No. 2, Feb. 1, 2006.

Jin, et al. "A simultaneous equation method-based online secondary path modeling algorithm for active noise control", Journal of Sound and Vibration, Apr. 25, 2007, pp. 455-474, vol. 303, No. 3-5, London, GB.

Toochinda, et al. "A Single-Input Two-Output Feedback Formulation for ANC Problems," Proceedings of the 2001 American Control Conference, Jun. 2001, pp. 923-928, vol. 2, Arlington, VA.

Kuo, et al., "Active Noise Control: A Tutorial Review," Proceedings of the IEEE, Jun. 1999, pp. 943-973, vol. 87, No. 6, IEEE Press, Piscataway, NJ.

Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.

Mali, Dilip, "Comparison of DC Offset Effects on LMS Algorithm and its Derivatives," International Journal of Recent Trends in Engineering, May 2009, pp. 323-328, vol. 1, No. 1, Academy Publisher.

Kates, James M., "Principles of Digital Dynamic Range Compression," Trends in Amplification, Spring 2005, pp. 45-76, vol. 9, No. 2, Sage Publications.

Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.

Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.

Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.

Davari, et al., "A New Online Secondary Path Modeling Method for Feedforward Active Noise Control Systems," IEEE International Conference on Industrial Technology, Apr. 21-14, 2008, pp. 1-6, Chengdu, China.

Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.

Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.

Pfann, et al., "LMS Adaptive Filtering with Delta-Sigma Modulated Input Signals", IEEE Signal Processing Letters, vol. 5, No. 4, Apr. 1998.

Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.

Ryan, et al., "Optimum near-field performance of microphone arrays subject to a far-field beampattern constraint", 2248 J. Acoust. Soc. Am. 108, Nov. 2000.

Cohen, et al., "Noise Estimation by Minima Controlled Recursive Averaging for Robust Speech Enhancement", IEEE Signal Processing Letters, Vol. 9, No. 1, Jan. 2002.

Martin, "Noise Power Spectral Density Estimation Based on Optimal Smoothing and Minimum Statistics", IEEE Trans. on Speech and Audio Processing, col. 9, No, 5, Jul. 2001.

Martin, "Spectral Subtraction Based on Minimum Statistics", Proc. 7th EUSIPCO '94, Edinburgh, U.K., Sep. 13-16, 1994, pp. 1182-1195.

Cohen, "Noise Spectrum Estimation in Adverse Environments: Improved Minima Controlled Recursive Averaging", IEEE Trans. on Speech & Audio Proc., vol. 11, Issue 5, Sep. 2003.

International Search Report and Written Opinion of the International Searching Authority, International Patent Application No. PCT/US2014/017343, mailed Aug. 8, 2014, 22 pages.

International Search Report and Written Opinion of the International Searching Authority, International Patent Application No. PCT/US2014/018027, mailed Sep. 4, 2014, 14 pages.

International Search Report and Written Opinion of the International Searching Authority, International Patent Application No. PCT/US2014/017374, mailed Sep. 8, 2014, 13 pages.

International Search Report and Written Opinion of the International Searching Authority, International Patent Application No. PCT/US2014/019395, mailed Sep. 9, 2014, 14 pages.

International Search Report and Written Opinion of the International Searching Authority, International Patent Application No. PCT/US2014/019469, mailed Sep. 12, 2014, 13 pages.

Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.

Zhang, Ming et al., "A Robust Online Secondary Path Modeling Method with Auxiliary Noise Power Scheduling Strategy and Norm

(56) References Cited

OTHER PUBLICATIONS

Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B. et al., Adaptive Noise Cancelling; Principles and Applications, Proceedings of the IEEE, IEEE, New York, NY, U.S. vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, New York. US, vol. 43, No. 8, Aug. 1995, pp. 1819-1829.
International Search Report and Written Opinion of the International Searching Authority, International Patent Application No. PCT/US2014/040999, mailed Oct. 18, 2014, 12 pages.
International Search Report and Written Opinion of the International Searching Authority, International Patent Application No. PCT/US2034/049407, mailed Jun. 18, 2914, 13 pages.
Hurst, et al., "An improved double sampling scheme for switched-capacitor delta-sigma modulators", 1992 IEEE Int. Symp. On Circuits and Systems, May 10-13, 1992, vol. 3, pp. 1179-1182, San Diego, CA.
Senderowicz, et al., "Low-Voltage Double-Sampled Delta-Sigma Converters", IEEE Journal on Solid-State Circuits, Dec. 1997, pp. 1907-1919, vol. 32, No. 12, Piscataway, NJ.
Lopez-Caudana, Edgar Omar, "Active Noise Cancellation: The Unwanted Signal and The Hybrid Solution", Adaptive Filtering Applications, Dr. Lino Garcia (Ed.), Jul. 2011, pp. 49-84, ISBN: 978-953-307-306-4, InTech.
Kuo, et al., "Residual noise shaping technique for active noise control systems", J. Acoust. Soc. Am. 95 (3), Mar. 1994, pp. 1665-1668.
Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.
Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages (pp. 1-12 in pdf), Pensacola, FL, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
James G. Ryan, Rafik A. Goubran, "Optimum near-field performance of microphone arrays subject to a far-field beampattern constraint ", 2248 J. Acoust. Soc. Am. 108, Nov. 2000.
I. Cohen, B. Berdugo, "Noise Estimation by Minima Controlled Recursive Averaging for Robust Speech Enhancement", IEEE Signal Processing Letters, vol. 9, No. 1, Jan. 2002.
R. Martin, "Noise Power Spectral Density Estimation Based on Optimal Smoothing and Minimum Statistics", IEEE Trans. on Speech and Audio Processing, col. 9, No. 5, Jul. 2001.
R. Martin, "Spectral Subtraction Based on Minimum Statistics", Proc. 7th EUSIPCO '94, Edinburgh, U.K., Sep. 13-16, 1994, pp. 1182-1195.
I. Cohen, "Noise Spectrum Estimation in Adverse Environments: Improved Minima Controlled Recursive Averaging", IEEE Trans. on Speech & Audio Proc., vol. 11, Issue 5, Sep. 2003.
A.A. Miliani, G. Kannan, and I.M.S. Panahi, "On maximum achievable noise reduction in ANC systems", in Proc. ICASSP, 2010, pp. 349-352, Mar. 2010.

* cited by examiner

CLOSE TALK DETECTOR FOR NOISE CANCELLATION

CROSS-REFERENCE TO RELATED APPLICATIONS

The present application claims priority from Provisional U.S. Patent Application No. 61/701,187 filed on Sep. 14, 2012, and incorporated herein by reference.

FIELD OF THE INVENTION

A detection system and method for detecting when a background noise measured in a noise cancellation circuit contains speech from a person speaking too closely to the device is disclosed. In particular, the present detection system and method are directed toward a close talk detector for a noise cancellation system for a cell phone or the like.

BACKGROUND OF THE INVENTION

A personal audio device, such as a wireless telephone, may include a noise canceling circuit to reduce background noise in audio signals. One example of such a noise cancellation circuit is an active noise cancellation circuit that adaptively generates an anti-noise signal from a reference microphone signal and injects the anti-noise signal into the speaker or other transducer output to cause cancellation of ambient audio sounds. An error microphone may also be provided proximate the speaker to measure the ambient sounds and transducer output near the transducer, thus providing an indication of the effectiveness of the noise canceling. A processing circuit uses the reference and/or error microphone, optionally along with a microphone provided for capturing near-end speech, to determine whether the noise cancellation circuit is incorrectly adapting or may incorrectly adapt to the instant acoustic environment and/or whether the anti-noise signal may be incorrect and/or disruptive and then take action in the processing circuit to prevent or remedy such conditions.

Examples of such noise cancellation systems are disclosed in published U.S. Patent Application 2012/0140943, published on Jun. 7, 2012, and in Published U.S. Patent Application 2012/0207317, published on Aug. 16, 2012, both of which are incorporated herein by reference. Both of these references are assigned to the same assignee as the present application and one names at least one inventor in common and thus are not prior art to the present application but are provided to facilitate the understating of noise cancellation circuits as applied in the field of use. These references are provided by way of background only to illustrate one problem solved by the present invention. They should not be taken as limiting the close-talk detector for noise cancellation to any one type of multi-microphone application or noise cancellation circuit.

Referring now to FIG. 1, a wireless telephone 10 is shown in proximity to a human ear 5. Wireless telephone 10 includes a transducer, such as speaker SPKR that reproduces distant speech received by wireless telephone 10, along with other local audio events such as ring tones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as battery low and other system event notifications. A near-speech microphone NS is provided to capture near-end speech, which is transmitted from wireless telephone 10 to the other conversation participant(s).

Wireless telephone 10 includes active noise canceling circuits and features that inject an anti-noise signal into speaker SPKR to improve intelligibility of the distant speech and other audio reproduced by speaker SPKR. A reference microphone R is provided for measuring the ambient acoustic environment and is positioned away from the typical position of a user's mouth, so that the near-end speech is minimized in the signal produced by reference microphone R. Prior art noise cancellation circuits rely on the use of two microphones E and R. The embodiment of FIG. 1 also provides a third microphone, near-speech microphone NS, in order to further improve the noise cancellation operation by monitoring the ambient disturbance to the noise cancellation system when wireless telephone 10 is in close proximity to ear 5. Exemplary circuit 14 within wireless telephone 10 includes an audio CODEC integrated circuit 20 that receives the signals from reference microphone R, near speech microphone NS, and error microphone E and interfaces with other integrated circuits such as an RF integrated circuit 12 containing the wireless telephone transceiver.

In general, the noise cancellation techniques measure ambient acoustic events (as opposed to the output of speaker SPKR and/or the near-end speech) impinging on reference microphone R, and by also measuring the same ambient acoustic events impinging on error microphone E, the noise cancellation processing circuits of illustrated wireless telephone 10 adapt an anti-noise signal generated from the output of reference microphone R to have a characteristic that minimizes the amplitude of the ambient acoustic events at error microphone E. Since acoustic path P(z) (also referred to as the Passive Forward Path) extends from reference microphone R to error microphone E, the noise cancellation circuits are essentially estimating acoustic path P(z) combined with removing effects of an electro-acoustic path S(z) (also referred to as Secondary Path) that represents the response of the audio output circuits of CODEC IC 20 and the acoustic/electric transfer function of speaker SPKR including the coupling between speaker SPKR and error microphone E in the particular acoustic environment, which is affected by the proximity and structure of ear 5 and other physical objects and human head structures that may be in proximity to wireless telephone 10, when wireless telephone is not firmly pressed to ear 5.

The dual microphone (microphones R and NS) system of FIG. 1 is widely used in mobile telephony for uplink noise suppression. In order to protect the noise cancellation system, an oversight mechanism requires audio signals from microphones R and NS in order to detect certain situations, such as close talk, wind/scratch noise, howling, and the like. Close talk, as the term is known, occurs when the near-end user is talking while holding the phone to his/her ear. Howling occurs when an anti-noise signal is picked up by microphone R, and it is played out speaker SPKR. The speaker output gets coupled back to the reference microphone R and sets up a positive feedback loop. Howling can occur, for example, if a user cups their hand from the speaker back to the reference microphone R or if there is some internal leakage path. Scratching is a term used to describe physical contact with a microphone, which produces a loud scratching noise.

Close talk, as the term is known, occurs when the near-end user is talking while holding the phone to his/her ear. When close talking occurs, the noise cancellation system may not work properly, as the local loud speech (close talk) may distract the adaptive filter, due to the path-change of acoustic path P(z). Preferably, a loud close talk event should be detected and the noise cancellation system adaptive filter should then be frozen (e.g., discontinue adapting, at least temporarily) so as to not react to the event. If close talking is not loud enough—e.g., it is not as strong as the ambient noise, there is no need to detect it. The traditional voice activity detector also treats the ambient highly non-stationary noise, including the ambient speech, as the voice. However, the ANC system needs to properly measure the ambient noise, no matter if they are stationary or non-stationary, as long as the noise is not too close to the ANC device.

Published U.S. Patent Application No. 2011/0106533 to Yu, published on May 5, 2011 and incorporated herein by reference, discloses a multi-microphone Voice Activity Detector (VAD) as illustrated in FIG. 2. Referring to FIG. 2, the VAD system 300 includes a near microphone 102*a*, a far microphone 102*b*, analog to digital converters 302*a* and 302*b*, band pass filters 304*a* and 304*b*, signal level estimators 306*a* and 306*b*, noise level estimators 308*a* and 308*b*, dividers 310*a* and 310*b*, unit delay elements 312*a* and 312*b*, and a VAD decision block 314.

The system of FIG. 2 detects close talking based on the Signal-to-Noise Ratio (SNR) estimations at the two channels. The system tries to detect close talking even at low SNR values. However, impulsive ambient noise (non-close talk) may falsely trigger the close talk detector, as the VAD decision is based on a difference between the two SNR ratios.

Thus, it remains a requirement in the art to provide a system for detecting loud close talking reliably, such that when close talking occurs, the noise cancellation system can be adjusted to not adapt to the close talk signal which causes path change of acoustic path P(z). On the other hand, the ambient impulsive/non-stationary noise can still be properly measured to maintain the accurate estimation of ambient noise level.

SUMMARY OF THE INVENTION

The present detection system and method provide an improved close-talk detector, which is not affected by the power levels or SNR of non-close-talk ambient disturbances. Power levels of both a voice and a reference microphone are measured, and the ratio r of these power levels is determined. The inventors have discovered through mathematical analysis and testing that this ratio of power levels is directly proportional to the distance that a close talker is located relative to the two microphones. If the ratio r is greater than a predetermined threshold (e.g., 7 dB), then close talking is determined to be occurring, and the noise cancellation circuit may be suitably attenuated to disregard the close talking signal in the noise cancellation process. If the ratio r is less than the predetermined threshold, then the signal is determined to be loud ambient noise or some other non-close-talking signal, and noise cancellation processing is not affected by the close talk detection circuit due to a path-change of acoustic path P(z).

The present detection system and method reliably detects close talking without being falsely triggered by other events, such as loud ambient noise and the like. As a result, artifacts that result in an audio signal when a noise cancellation circuit in accordance with the prior art tries to compensate for close talking, do not occur. The present detection system and method can be readily implemented within an integrated circuit and even within noise cancellation circuitry, without the need for any additional external hardware (third microphone, or the like). Thus, the present detection system and method can be readily implemented into existing cellular phone designs with little modification and in a cost-effective manner, providing performance improvement at little or no additional hardware cost.

The present invention may be applied to cellular telephones, pad devices and other portable audio devices where close talk detecting is desired. While disclosed herein in the context of a cellular telephone in the preferred embodiment, the present invention may be applied generally to portable devices as well as other applications where close talk detection is used. In addition, the present invention may be applied to other audio devices and telecommunication devices, including telephone headsets, portable phones, teleconferencing equipment, public address systems, and the like.

DETAILED DESCRIPTION OF THE INVENTION

Figure 1:
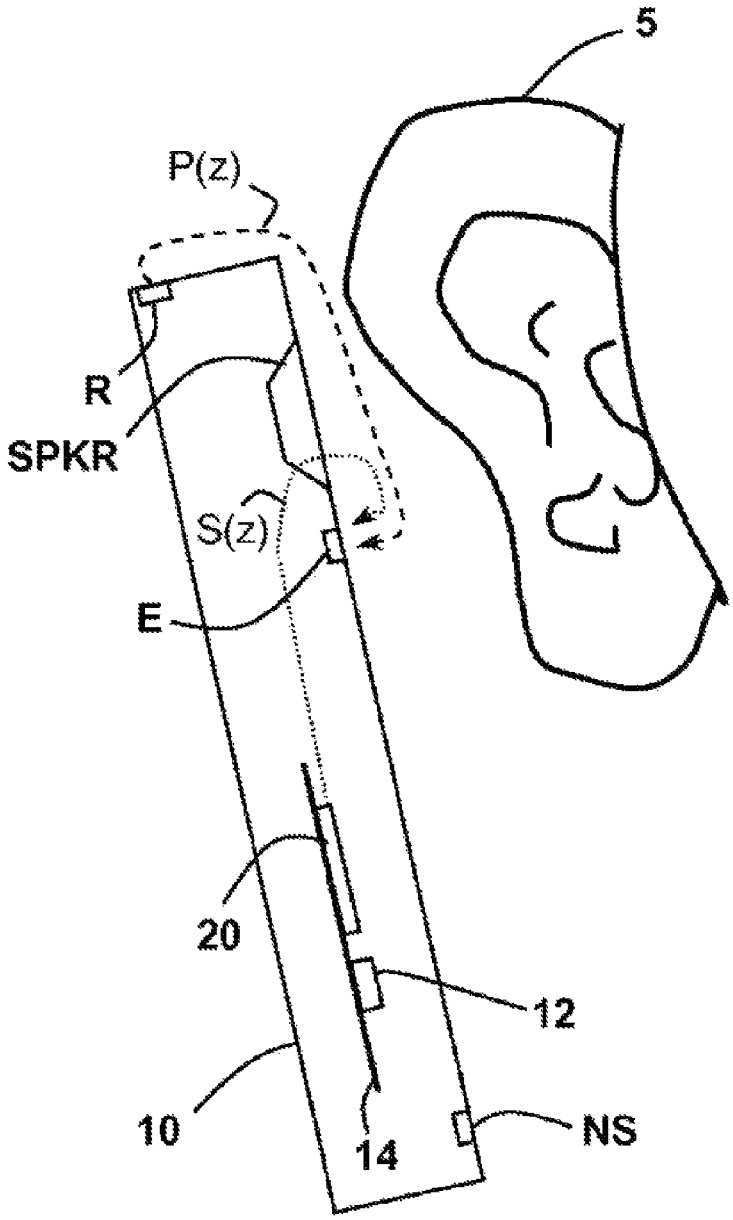
FIG. 1 is a diagram illustrating how dual microphones may be used in a noise cancellation circuit in a cellular telephone.
Figure 2:
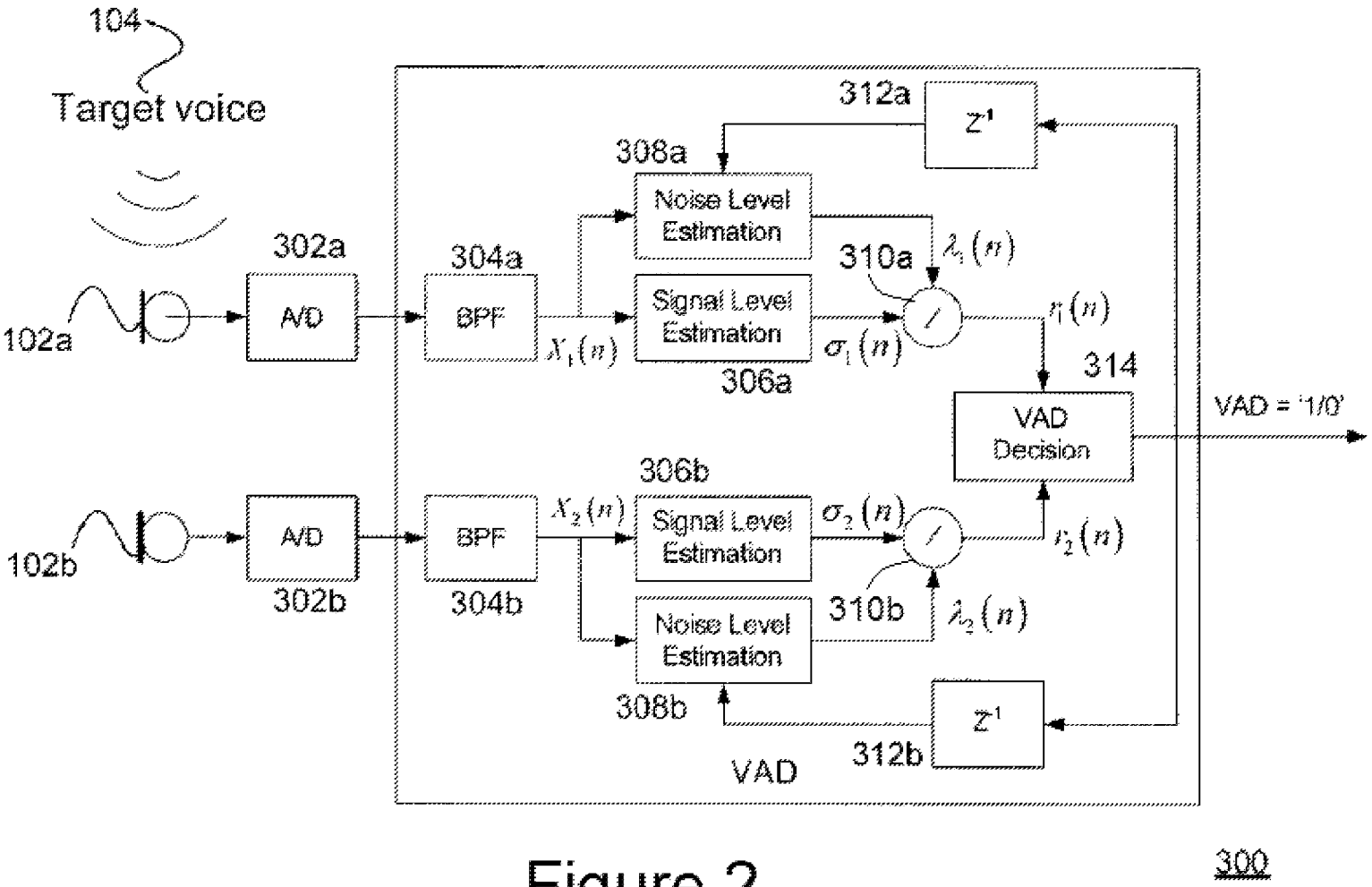
FIG. 2 is a block diagram that illustrates an example voice activity detector system according to the prior art.
Figure 3:
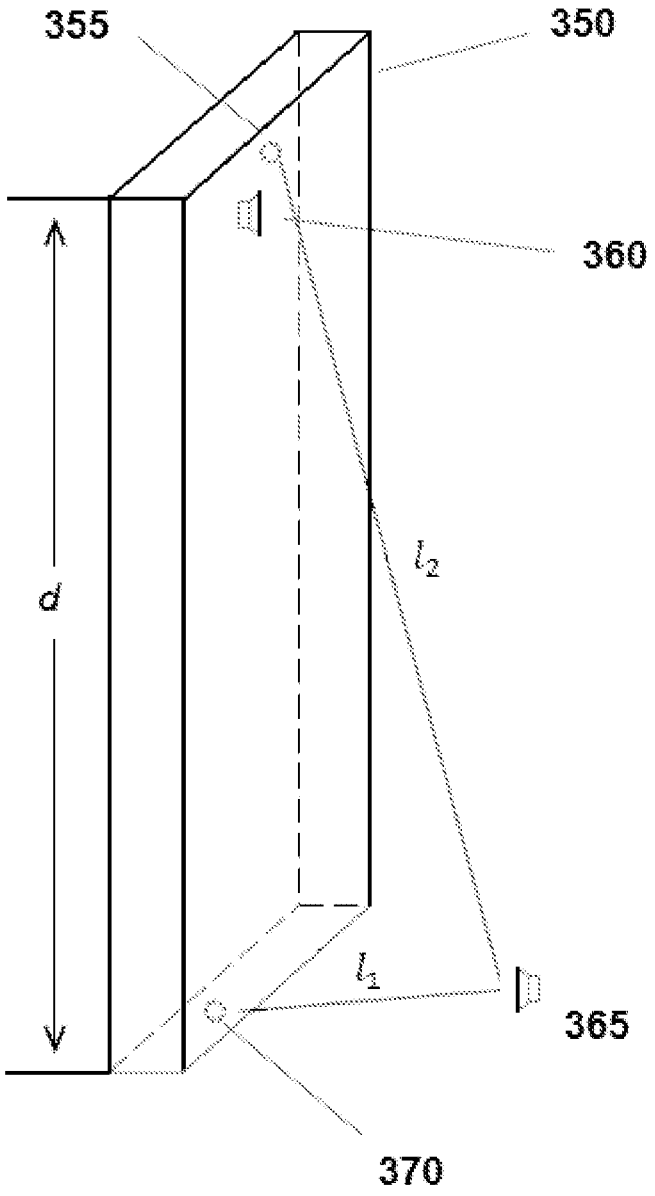
FIG. 3 is a diagram illustrating the distance of a close talker from both the dual microphones on a typical cell phone.

FIG. 3 is a diagram illustrating the distance of a close talker from both the dual microphones on a typical cell phone. Referring to FIG. 3, a cell phone 350 is provided with an earpiece speaker 360 on the front side of the panel for the user to hear communications. Cell phone 350 is approximately 10-15 centimeters in height, as represented by reference letter d. Two microphones are provided, as discussed above in connection with FIGS. 1 and 2. A near-speech microphone (NS) 370 designed to pick up the user's voice and ambient background noise is provided at the bottom of the device. A reference microphone 355 is provided at the back of the device to pick up ambient noise levels. In FIG. 3, a "close talker" is represented pictorially by speaker 365, even though the close talker is a person. The close talker may be located at a distance $l_1$ from the near-speech microphone (NS) 370 and a distance $l_2$ from the reference microphone (R).

If the close talker 365 is close enough, and the talker is closer to one microphone 370 than the other 355, which is usually the case, the acoustic sound wave arrives at the two microphones 370, 355, with different amounts of pressure. The digital signals received at the two microphones have different power, which are proportional to the inverse of distance from the close talker to the microphone. This power level may be represented as:

$$P_i \propto \frac{1}{l_i^2} \tag{1}$$

where $P_i$ is the power level, $l_i$ is the distance, and i indicates at which microphone the signal is received. For the purposes of this application, i=1 indicates the reference microphone (R) 355 and i=2 indicates the near-speech microphone (NS) 370 of FIG. 3.

Power level P may be calculated in a number of ways. In the preferred embodiment, power level is a root-mean-square (RMS) based power estimation. Traditionally, this power level would be calculated using a strict RMS calculation such as:

$$P = \sqrt[2]{\frac{1}{N}\sum_{i=1}^{N} x^2(i)} \tag{2}$$

Where x(i) is the input signal and i represents the frequency bin. However, in the present invention, to save computations in the preferred embodiment, only the sum of the squares of a block of input signals x(i) is used:

$$P = \sum_{i=1}^{N} x^2(i) \tag{3}$$

This simplified calculation works as both microphone channels are using the same length of data and the square root is calculated when converting the smoothed power level P into decibels (dB).

The powers $P_1$ and $P_2$, received at different microphones have the following relationship which can be defined as a ratio, r. The distance $l_2$ will always be less than the sum of distance d and $l_1$ (i.e., $l_2<l_1+d$):

$$r = \frac{P_1}{P_2} = \frac{l_2^2}{l_1^2} < \frac{(l_1+d)^2}{l_1^2} \tag{4}$$

When the talker is closer to near-speech microphone (NS) 370 than reference microphone 355, and $l_1$ is smaller than $l_2$, then the range of the ratio r can be expressed as:

$$1 < r < \frac{(l_1+d)^2}{l_1^2} \tag{5}$$

This ratio, r could be very large. On the other hand, when the talker is far away, $l_1$ is too large, $l_1 \gg d$, $r \approx 1$. Therefore, the following is the close talk detection criterion:

$$\text{if } r>\gamma\text{, close talk}$$

$$\text{if } r\leq\gamma\text{, no close talk} \tag{6}$$

where γ represents a predetermined cutoff level for determining close talking. In the preferred embodiment, γ=7 dB.

The ratio r, although calculated from power levels, represents the ratio of the distance of the speaker to the two microphones. When the ratio r is large, it means that the close talker 365 is much closer to the near-speech microphone (NS) 370 than to the reference microphone (R) 365. Given r and d, the distance between the two microphones, the actual location of the close talker is calculated within a certain range. Without a loss of generality, when the close talker is closer to the near-speech microphone 370, then r>1.

If the three-dimensional locations of the close talker 365 are denoted as position s, and the position of the near-speech microphone (NS) 370 as position $m_1$ and the reference microphone 355 as position $m_2$, then these three positions are defined in terms of three-dimensions as:

$$s=[x_s,y_s,z_s]^T, m_1=[x_1,y_1,z_1]^T \text{ and } m_2=[x_2,y_2,z_2]^T \tag{7}$$

The location of source s can be expressed as follows:

$$r = \frac{P_1}{P_2} = \frac{l_2^2}{l_1^2} = \frac{\|s-m_2\|^2}{\|s-m_1\|^2} \tag{8}$$

$$\Rightarrow \left\|s-\left[m_1+\frac{1}{r-1}(m_1-m_2)\right]\right\|^2 = \frac{r}{(r-1)^2}\|m_1-m_2\|^2 \tag{9}$$

The value of r, in effect, defines a sphere. The location of the close talker 365 resides on the surface of a sphere defined by equation (9) above. Given the ratio r, equation (9) yields the center and radius of the sphere where the close talker 365 could be. As $r\rightarrow\infty$, the center of this sphere becomes the location $m_1$ of the near-speech microphone (NS) 370, and the radius goes to 0, which means the loud talker is at the same location $m_1$ as the near-speech microphone (NS) 370. As $r\rightarrow 1$, the center and the radius approach towards infinity. This means the loud talker is either located at an infinite far field (background ambient noise) or is located on a surface that exactly between the two microphones 370, 355.

Thus, if $r\approx 1$, the sound source has an equal distance to the two microphones, either a far field, or at the middle between the two microphones. However, if $r\gg 1$ the sound source is much closer to near-speech microphone (NS) 370 than to reference microphone 355. Again the criteria of Equation (6) can be used to determine the presence of close talking.

In a loud ambient environment, the value for r may be calculated as follows:

$$r = \frac{N_1+P_1}{N_2+P_2} = \frac{N_1}{N_2}\cdot\frac{1+P_1/N_1}{1+P_2/N_2} \quad \frac{N_1}{N_2} \simeq 1 \tag{10}$$

where $N_1$ and $N_2$ are ambient noise, no matter if they are stationary or non-stationary, received at the near-speech microphone (NS) 370 and the reference microphone 355, respectively. When the ambient noise is loud, r will become much smaller than when the ambient noise is quiet. This event causes the close-talk flag value r to vanish, which is exactly as desired for a close-talk detector. In other words, the detector of the present detection system and method will not trigger a "false positive" based on loud ambient noise.

Figure 4:
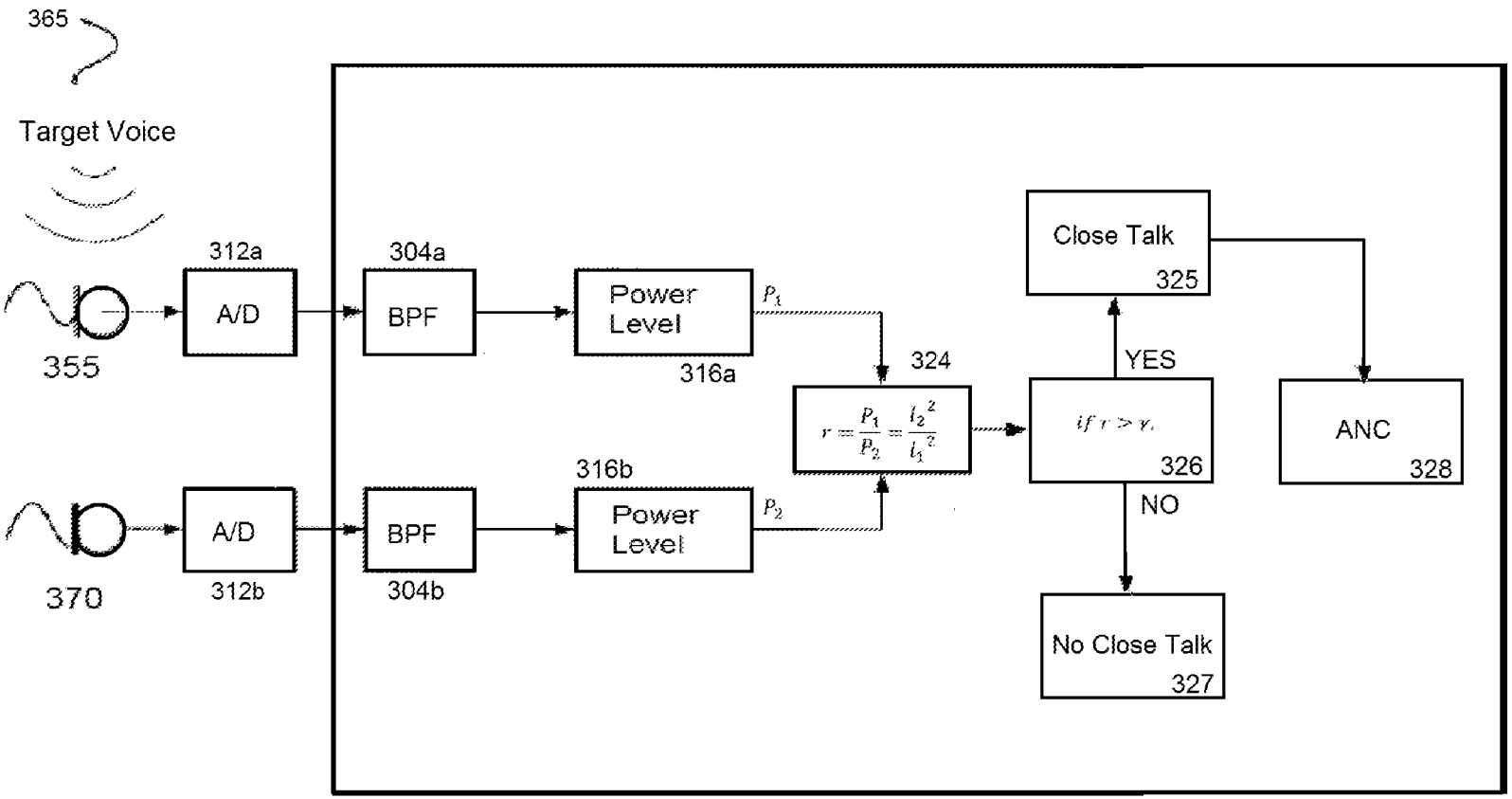
FIG. 4 is a block diagram of the system of the present detection system and method.

FIG. 4 is a block diagram of the system of the present detection system and method. Referring to FIG. 4, close talk detect system 400 includes the reference microphone 355, the near-speech microphone (NS) 370, analog to digital converters 312*a* and 312*b*, band pass filters 304*a* and 304*b*, and power level estimators 316*a* and 316*b*. The output of power level estimators 316*a* and 316*b* are fed to block 324, where the ratio r is calculated according to equation (4). In block 326, the value of r is compared to value γ, which in the preferred embodiment is 7 dB. If r>γ, then close talking is detected in block 325, and a signal sent to adaptive noise cancellation system 328, suppressing the action of the noise cancellation circuit with regard to the close talk signal. This suppression may be achieved by "freezing" the noise cancellation circuit to not update the model of P(z)/S(z) for the noise cancellation signal, until the close talk event ends. If r<γ, then no close talk event is indicated, and no action is taken.

Other actions may be taken in response to the detection of close talking. If close talk is detected, then the updating of the noise cancellation circuit may be modified to slow adaptation of the noise cancellation circuit. Alternately, altering updating of the noise cancellation circuit may comprise stopping adaptation of the noise cancellation circuit. In addition, altering updating of the noise cancellation circuit comprises increasing a least means square filter leakage term in the noise cancellation circuit.

While the preferred embodiment and various alternative embodiments of the invention have been disclosed and described in detail herein, it may be apparent to those skilled in the art that various changes in form and detail may be made therein without departing from the spirit and scope thereof.

We claim:

1. In a portable device including at least a first microphone and a second microphone receiving sounds in the vicinity of the portable device and outputting audio signals, each of the at least first and second microphones being located on the portable device at different distances respective to a talker's mouth in ordinary operation, and a noise cancellation circuit, a close talk detector, comprising:

a power level detector, coupled to the at least first and second microphones, receiving the audio signals from the at least first and second microphones, measuring power levels of the audio signals from the first and second microphones, and comparing the power levels from the at least first and second microphones to produce a ratio of the power levels of the at least first and second microphones; and a comparator for comparing the ratio of the power levels of the at least first and second microphones to a predetermined threshold and detecting close talk if the ratio of the power levels of the at least first and second microphones exceeds the predetermined threshold, wherein the comparator outputs a signal to the noise cancellation circuit to alter updating of the noise cancellation circuit when the close talk is detected to prevent the noise cancellation circuit from adapting to the talker's voice.

2. The close talk detector of claim 1, wherein altering updating of the noise cancellation circuit comprises slowing adaptation of the noise cancellation circuit.

3. The close talk detector of claim 1, wherein altering updating of the noise cancellation circuit comprises increasing a least means square filter leakage term in the noise cancellation circuit.

4. In a portable device including at least a first microphone and a second microphone receiving sounds in the vicinity of the portable device and outputting audio signals, each of the at least first and second microphones being located on the portable device at different distances respective to a talker's mouth in ordinary operation, and a noise cancellation circuit, a close talk detector, comprising:

a power level detector, coupled to the at least first and second microphones, receiving the audio signals from the at least first and second microphones, measuring power levels of the audio signals from the first and second microphones, and comparing the power levels from the at least first and second microphones to produce a ratio of the power levels of the at least first and second microphones; and a comparator for comparing the ratio of the power levels of the at least first and second microphones to a predetermined threshold and detecting close talk if the ratio of the power levels of the at least first and second microphones exceeds the predetermined threshold, wherein the comparator outputs a signal to the noise cancellation circuit to alter updating of the noise cancellation circuit when the close talk is detected, and wherein altering updating of the noise cancellation circuit comprises stopping adaptation of the noise cancellation circuit.

5. In a portable device including at least a first microphone and a second microphone receiving sounds in the vicinity of the portable device and outputting audio signals, each of the at least first and second microphones being located on the portable device at different distances respective to a talker's mouth in ordinary operation, and a noise cancellation circuit, a close talk detector, comprising:

a power level detector coupled to the at least first and second microphones receiving the audio signals from the at least first and second microphones measuring power levels of the audio signals from the first and second microphones and comparing the power levels from the at least first and second microphones to produce a ratio of the power levels of the at least first and second microphones; and a comparator for comparing the ratio of the power levels of the at least first and second microphones to a predetermined threshold and detecting close talk if the ratio of the power levels of the at least first and second microphones exceeds the predetermined threshold, wherein the comparator outputs a signal to the noise cancellation circuit to alter updating of the noise cancellation circuit when the close talk is detected, and wherein the predetermined threshold is 7 dB, and if the ratio of the power levels of the at least first and second microphones is greater than the pre-determined, the close talk is detected, and if the ratio of power levels of the at least first and second microphones is less than or equal to the predetermined threshold, the close talk is not detected.

6. A method of detecting a close talker near a portable device including at least a first microphone and a second microphone receiving sounds in the vicinity of the portable device and outputting audio signals, each of the at least first and second microphones being located on the portable device at different distances respective to a talker's mouth in ordinary operation, and, the method comprising:

calculating power level values of the audio signals from the at least first and second microphones;

comparing the power levels from the at least first and second microphones to produce a ratio of the power levels of the at least first and second microphones;

comparing the ratio of power levels of the at least first and second microphones to a predetermined threshold;

determining when close talk of the talker is detected if the ratio of the power levels of the at least first and second microphones exceeds the predetermined threshold; and outputting a signal to a noise cancellation circuit to alter updating of the noise cancellation circuit when the close talk is detected to prevent the noise cancellation circuit from adapting to the talker's voice.

7. The method of claim 6, wherein altering updating of the noise cancellation circuit comprises slowing adaptation of the noise cancellation circuit.

8. The method of claim 6, wherein altering updating of the noise cancellation circuit comprises increasing a least means square filter leakage term in the noise cancellation circuit.

9. A method of detecting a close talker near a portable device including at least a first microphone and a second microphone receiving sounds in the vicinity of the portable device and outputting audio signals, each of the at least first and second microphones being located on the portable device at different distances respective to a talker's mouth in ordinary operation, and, the method comprising:

calculating power level values of the audio signals from the at least first and second microphones;

comparing the power levels from the at least first and second microphones to produce a ratio of the power levels of the at least first and second microphones;

comparing the ratio of power levels of the at least first and second microphones to a predetermined threshold;

determining when close talk of the talker is detected if the ratio of the power levels of the at least first and second microphones exceeds the predetermined threshold; and outputting a signal to a noise cancellation circuit to alter updating of the noise cancellation circuit when the close talk is detected, wherein altering updating of the noise cancellation circuit comprises stopping adaptation of the noise cancellation circuit.

10. A method of detecting a close talker near a portable device including at least a first microphone and a second microphone receiving sounds in the vicinity of the portable device and outputting audio signals, each of the at least first and second microphones being located on the portable device at different distances respective to a talker's mouth in ordinary operation, and, the method comprising:

calculating power level values of the audio signals from the at least first and second microphones;

comparing the power levels from the at least first and second microphones to produce a ratio of the power levels of the at least first and second microphones;

comparing the ratio of power levels of the at least first and second microphones to a predetermined threshold;

determining when close talk of the talker is detected if the ratio of the power levels of the at least first and second microphones exceeds the predetermined threshold; and outputting a signal to a noise cancellation circuit to alter updating of the noise cancellation circuit when the close talk is detected, wherein the predetermined threshold is 7 dB, and if the ratio of power levels of the at least first and second microphones is greater then 7 dB, the close talk is detected, and if the ratio of power levels of the at least first and second microphones is less than or equal to 7 dB, the close talk is not detected.

11. A telecommunications device, comprising:

at least a first microphone and a second microphone receiving sounds in the vicinity of the portable device and outputting audio signals, each of the at least first and second microphones being located on the portable device at different distances respective to a talker's mouth in ordinary operation;

a noise cancellation circuit including a close talk detector, comprising:

at least a first microphone and a second microphone, on the cellular telephone, receiving sounds in the vicinity of the cellular telephone and outputting audio signals, each of the at least first and second microphones being located on the cellular phone at different distances respective to a talker's mouth in ordinary operation;

a power level detector, coupled to the at least first and second microphones, receiving the audio signals from the at least first and second microphones, measuring power levels of the audio signals from the first and second microphones, and comparing the power levels from the at least first and second microphones to produce a ratio of the power levels of the at least first and second microphones; and a comparator for comparing the ratio of the power levels of the at least first and second microphones to a predetermined threshold and detecting close talk if the ratio of the power levels of the at least first and second microphones exceeds the predetermined threshold, wherein the comparator outputs a signal to the noise cancellation circuit to alter updating of the noise cancellation circuit when the close talk is detected to prevent the noise cancellation circuit from adapting to the talker's voice.

12. The telecommunications device of claim 11, wherein altering updating of the noise cancellation circuit comprises slowing adaptation of the noise cancellation circuit.

13. The telecommunications device of claim 11, wherein altering updating of the noise cancellation circuit comprises increasing a least means square filter leakage term in the noise cancellation circuit.

14. A telecommunications device, comprising:

at least a first microphone and a second microphone receiving sounds in the vicinity of the portable device and outputting audio signals, each of the at least first and second microphones being located on the portable device at different distances respective to a talker's mouth in ordinary operation;

a noise cancellation circuit including a close talk detector, comprising:

at least a first microphone and a second microphone, on the cellular telephone, receiving sounds in the vicinity of the cellular telephone and outputting audio signals, each of the at least first and second microphones being located on the cellular phone at different distances respective to a talker's mouth in ordinary operation;

a power level detector, coupled to the at least first and second microphones, receiving the audio signals from the at least first and second microphones, measuring power levels of the audio signals from the first and second microphones, and comparing the power levels from the at least first and second microphones to produce a ratio of the power levels of the at least first and second microphones; and a comparator for comparing the ratio of the power levels of the at least first and second microphones to a predetermined threshold and detecting close talk if the ratio of the power levels of the at least first and second microphones exceeds the predetermined threshold, wherein the comparator outputs a signal to the noise cancellation circuit to alter updating of the noise cancellation circuit when the close talk is detected, and wherein altering updating of the noise cancellation circuit comprises stopping adaptation of the noise cancellation circuit.

15. A telecommunications device, comprising:

at least a first microphone and a second microphone receiving sounds in the vicinity of the portable device and outputting audio signals, each of the at least first and second microphones being located on the portable device at different distances respective to a talker's mouth in ordinary operation;

a noise cancellation circuit including a close talk detector, comprising:

at least a first microphone and a second microphone, on the cellular telephone, receiving sounds in the vicinity of the cellular telephone and outputting audio signals, each of the at least first and second microphones being located on the cellular phone at different distances respective to a talker's mouth in ordinary operation;

a power level detector coupled to the at least first and second microphones receiving the audio signals from the at least first and second microphones measuring power levels of the audio signals from the first and second microphones and comparing the power levels from the at least first and second microphones to produce a ratio of the power levels of the at least first and second microphones; and a comparator for comparing the ratio of the power levels of the at least first and second microphones to a predetermined threshold and detecting close talk if the ratio of the power levels of the at least first and second microphones exceeds the predetermined threshold, wherein the comparator outputs a signal to the noise cancellation circuit to alter updating of the noise cancellation circuit when the close talk is detected, and wherein the predetermined threshold is 7 dB, and if the ratio of the power levels of the at least first and second microphones is greater than the pre-determined, the close talk is detected, and if the ratio of power levels of the at least first and second microphones is less than or equal to the predetermined threshold, the close talk is not detected.

* * * * *